US006076609A

United States Patent [19]

Job

[11] Patent Number: 6,076,609

[45] Date of Patent: Jun. 20, 2000

[54] PULL ROPE SHORTENING DEVICE FOR FIRE EXTINGUISHING UNITS

[75] Inventor: Eduard J. Job, Ahrensburg, Germany

[73] Assignee: JOB Lizenz GmbH & Co. KG, Ahrensburg, Germany

[21] Appl. No.: 09/273,629

[22] Filed: Mar. 23, 1999

[30] Foreign Application Priority Data

Apr. 4, 1998 [EP] European Pat. Off. ..... 98106212

[51] Int. Cl.[7] ..... A62C 37/36

[52] U.S. Cl. ..... 169/42; 169/65; 169/46

[58] Field of Search ..... 169/42, 46, 47, 169/49, 65

[56] References Cited

U.S. PATENT DOCUMENTS

| | | | |
|---|---|---|---|
| 1,816,017 | 7/1931 | Loepsinger . | |
| 3,463,236 | 8/1969 | Flajole et al. | 169/42 |
| 5,871,056 | 8/1969 | Renna | 169/42 X |

FOREIGN PATENT DOCUMENTS

| | | |
|---|---|---|
| 510552 | 8/1979 | Australia . |
| 0339788 | 11/1989 | European Pat. Off. . |
| 1559693 | 1/1970 | Germany . |
| 3736242 | 5/1989 | Germany . |
| 196 35 177 A1 | 3/1998 | Germany . |

*Primary Examiner*—Lesley D. Morris
*Attorney, Agent, or Firm*—Friedrich Kueffner

[57] ABSTRACT

A pull rope shortening device for fire extinguishing units, particularly for kitchen exhaust hoods, includes a shortening element which deflects the pull rope which is under tension in order to shorten the length of the pull rope, wherein the shortening element is held in the position in which it shortens the length of the pull rope by a thermally released separating device. The shortening element is composed of a spring steel wire which is wound or bent in such a way that at each end thereof is formed an end eyelet for receiving the pull rope and at least one guide eyelet acting as a spring and guiding the pull rope is provided between the two ends.

4 Claims, 2 Drawing Sheets

PULL ROPE SHORTENING DEVICE FOR FIRE EXTINGUISHING UNITS

BACKGROUND OF THE INVENTION

1. Field of the Invention

The present invention relates to a pull rope shortening device for fire extinguishing units, particularly for kitchen exhaust hoods. The device includes a shortening element which deflects the pull rope which is under tension in order to shorten the length of the pull rope, wherein the shortening element is held in the position in which it shortens the length of the pull rope by a thermally released separating device.

2. Description of the Related Art

Pull rope shortening devices of the above-described type are known, for example, for holding and securing the pull ropes of kitchen exhaust hoods. The pull ropes end at a switching device which includes a locking valve for the fire extinguishing medium. In case of fire, the thermally released element, for example, a glass bulb, of the separating device is destroyed, so that the tension of the pull rod increases the length of the pull rod, the locking valve is opened and the fire extinguishing medium can reach the location of the fire.

Pull rope shortening devices known in the art frequently are constructed in such a way that the pull rope must be cut for receiving the shortening element. It has also already been proposed to construct the shortening element in the manner of a hinge, so that the pull rope no longer has to be cut for guiding and deflecting the pull rope by the hinge. However, such a hinge is a relatively complicated component and, therefore, the hinge is relatively expensive to manufacture.

SUMMARY OF THE INVENTION

Therefore, it is the primary object of the present invention to provide a pull rope shortening device of the above-described type which is of simple construction and can be manufactured inexpensively.

In accordance with the present invention, the shortening element is composed of a spring steel wire which is wound or bent in such a way that at each end thereof is formed an end eyelet for receiving the pull rope and at least one guide eyelet acting as a spring and guiding the pull rope is provided between the two ends.

Accordingly, the shortening element is composed of spring steel wire, preferably a single piece of spring steel wire, which is shaped or wound as described. The eyelets are wound and dimensioned in such a way that the pull rope can be placed in the eyelets without difficulties and interruptions. Since the element is made of spring steel, the spring force can be utilized for pretensioned the shortening element.

The shortening element is held in the shortening or tensioned position by the thermally released separating element, as it is described, for example, in DE-OS 196 35 177 (U.S. Pat. No. 5,927,890). The separating device proposed in this reference is composed of two joining members which are held together by the thermal release element, for example, a glass bulb. When the thermal release element is destroyed, the two joining members are separated and release the shortening element, so that this shortening element becomes longer as a result of the tension in the pull rope and the inherent tension of the shortening element and the pull rope is "elongated", possibly until it is forming a straight line. In any event, the separation of the release element causes the locking valve to be opened, so that the fire extinguishing medium can be directed through appropriate lines to the intended fire extinguishing points.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 2 shows the device after the thermal release element has been destroyed and the pull rope has been elongated;

DESCRIPTION OF THE PREFERRED EMBODIMENTS

Figure 1:
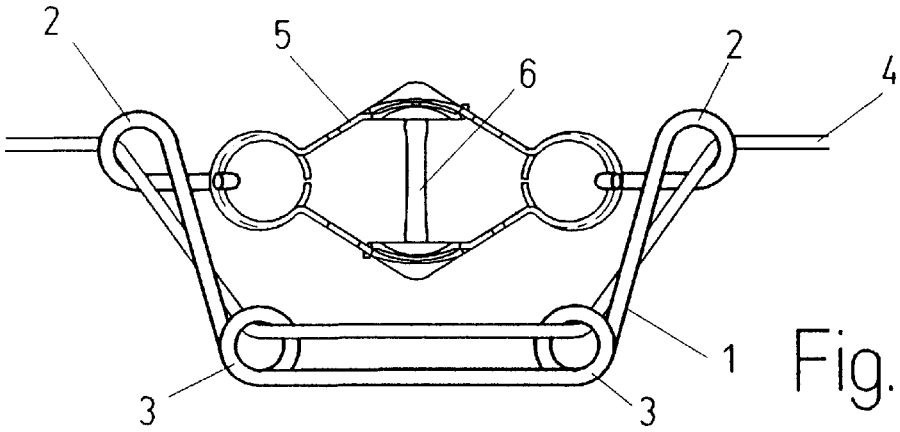
FIG. 1 is a top view of a first embodiment of a pull rope shortening device according to the present invention, shown in the tensioned state.

The shortening element 1 shown in FIGS. 1 to 4 is composed of a spring wire which is bent or wound in such a way that two end eyelets 2 and two guide eyelets 3 are formed.

The pull rope 4 is guided through the end eyelets 2 to the guide eyelets 3. The pull rope 4 extends without interruptions through the eyelets. It is readily apparent that the deflection of the pull rope 4 leads to a shortening of the rope. The ends of the shortening element 1 form hooks into which the thermally released separating device 5 composed of two joining members is in engagement. In the position shown in FIG. 1, the joining members are held together by a thermal release element 6; in the illustrated embodiment, the thermal release element 6 is a glass bulb. The shortening element 1 itself forms a spring which holds the individual components in position and is pretensioned in the release direction. The tension in the pull rope 4 acts in the same way.

Figure 2:
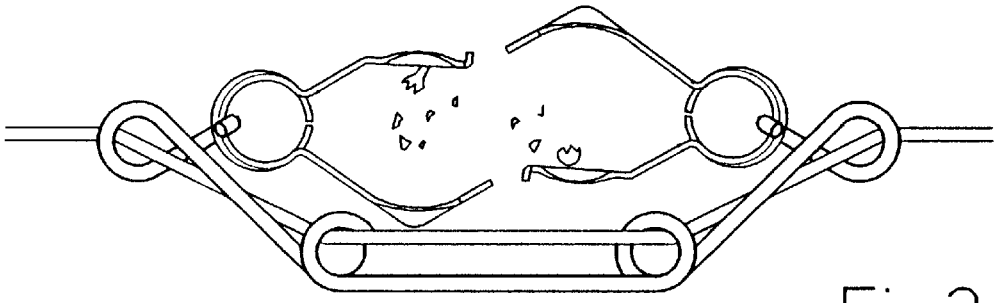
FIG. 2 is the same view as FIG. 1, except

It is apparent from FIG. 2 what happens when the thermal release element is destroyed, i.e., in the case of fire. When the thermal release element 6 is destroyed, the joining members of the thermally released separating device 5 are released, so that the rope 4 is no longer deflected to the same extent or is not deflected at all, so that the rope is elongated accordingly. This opens the locking valve, not shown, and the actual fire extinguishing process is triggered.

Figure 3:
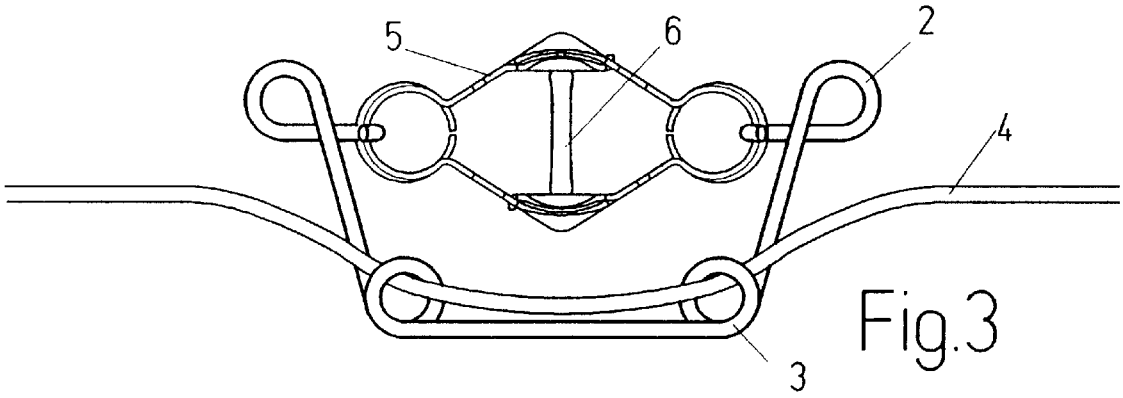
FIG. 3 is a view corresponding to FIG. 1, showing the pull rope being inserted into the eyelets.

FIG. 3 shows that the pull rope can be placed in the eyelets of the shortening element 1 without interruption.

Figure 4:
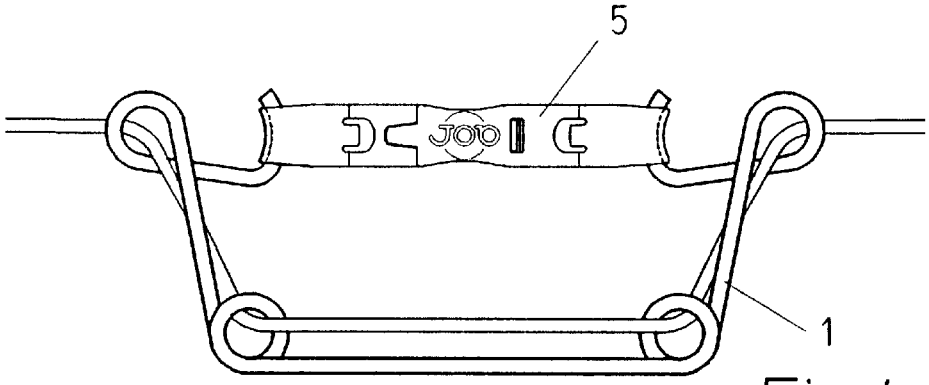
FIG. 4 is a view corresponding to FIG. 1 showing an embodiment in which the thermally released separating device is arranged turned by 90°.

FIG. 4 of the drawing shows a thermally released separating device 5 which is turned by 90° . Consequently, the hooks at the ends of the shortening element 1 are bent differently.

Figure 5:
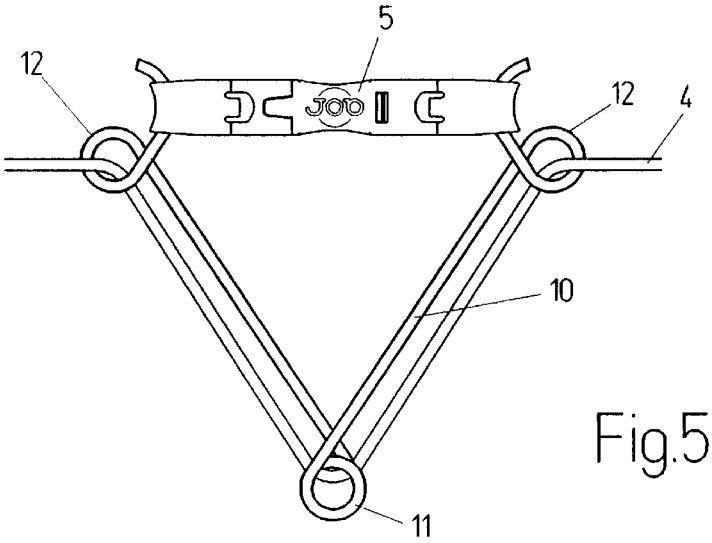
FIG. 5 is a view corresponding to FIG. 1 showing another embodiment of a pull rope shortening device according to the present invention in the form of an isosceles triangle, shown in the tensioned state.
Figure 6:
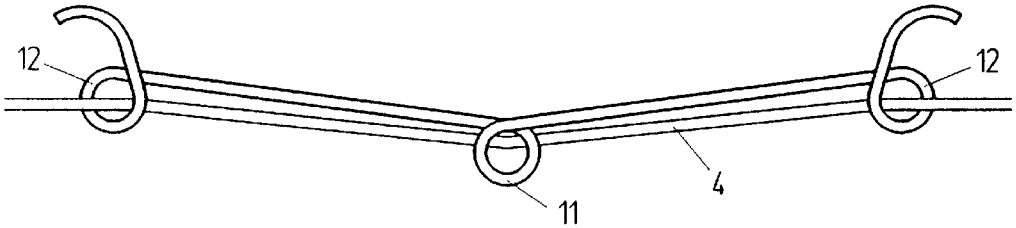
FIG. 6 is a top view of the embodiment of FIG. 5, shown in the non-tensioned state, i.e., after the separating device has been released.

The embodiment shown in FIGS. 5 and 6 has a simpler geometry. The shortening element 11 does not have the shape of a trapezoid as is the case in the embodiment of FIGS. 1 to 4, but of an isosceles triangle. Consequently, only one guide eyelet 11 is provided. The end eyelets are denoted by 12. The thermal release element otherwise acts in the same manner as that of FIGS. 1 and 2.

The guide eyelet 11 may also be in the form of a double winding if this is desired for obtaining certain geometric relationships or a certain spring characteristic.

Figure 7:
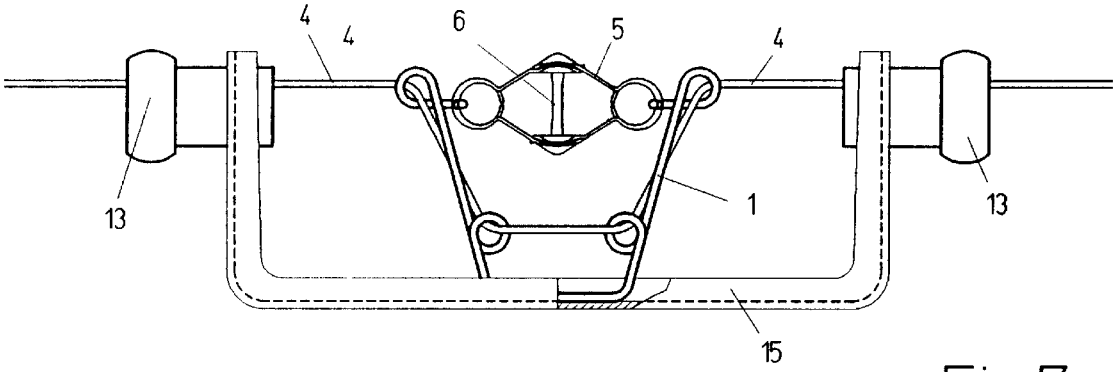
FIG. 7 is a top view of a guide stirrup for a pull rope shortening device according to the embodiments of FIGS. 1 to 4.

FIG. 7 shows the pull rope shortening device according to FIGS. 1 to 5 as it is positioned in a guide stirrup 15. The pull rope 4 is connected by means of connecting sleeves 13 to the pull rope of a kitchen exhaust hood device. The guide stirrup 15 has a U-shaped cross-section, so that the shortening element 1 is held in the illustrated position. A rotary movement about the axis of the pull rope is not possible.

While specific embodiments of the invention have been shown and described in detail to illustrate the inventive principles, it will be understood that the invention may be embodied otherwise without departing from such principles.

I claim:

1. A pull rope shortening device for fire extinguishing units, the device comprising a shortening element for guiding a pull rope under tension so that a length of the pull rope is shortened, a thermally released separating device for holding the shortening element in the position in which the length of the pull rope is shortened, wherein the shortening element is shaped from a spring steel wire so as to have an end eyelet at each end thereof for receiving the pull rope and at least one guide eyelet for guiding the pull rope, wherein the guide eyelet is shaped to act as a spring.

2. The device according to claim 1, wherein the shortening element is composed of a single piece of spring steel wire.

3. The device according to claim 1, wherein the shortening element is shaped in a tensioned position thereof in the form of an equilateral trapezoid having a longer and a shorter side, wherein at each end of the longer side is provided one of the end eyelets and at each end of the shorter side is provided a guide eyelet.

4. The device according to claim 1, wherein the shortening element is shaped in a tensioned state thereof as an isosceles triangle having legs, wherein an end eyelet is provided at an end of each leg and the guide eyelet is provided at a point of intersection of the legs.

* * * * *